US005315495A

United States Patent [19]

Buser

[11] Patent Number: 5,315,495

[45] Date of Patent: May 24, 1994

[54] ILLUMINATED SIGN DEVICE

[75] Inventor: Rudolph G. Buser, Wall, N.J.

[73] Assignee: The United States of America as represented by the Secretary of the Army, Washington, D.C.

[21] Appl. No.: 119,297

[22] Filed: Sep. 13, 1993

[51] Int. Cl.[5] ..... F21V 29/00

[52] U.S. Cl. ..... 362/373; 362/367; 362/812; 40/572; 40/575

[58] Field of Search ..... 40/549, 570, 572, 575; 362/235, 294, 367, 373, 375, 812

[56] References Cited

U.S. PATENT DOCUMENTS

| | | | |
|---|---|---|---|
| 3,984,069 | 10/1976 | Heyworth | 40/572 X |
| 4,973,951 | 11/1990 | Shigeta et al. | 40/572 X |
| 5,047,907 | 9/1991 | Hawkins | 362/812 X |
| 5,128,850 | 7/1992 | Juodvalkis | 362/812 X |

*Primary Examiner*—Stephen F. Husar

*Attorney, Agent, or Firm*—Milton W. Lee; Alain L. Bashore; Anthony T. Lane

[57] ABSTRACT

An illuminated sign device is disclosed includes a triangular housing with upper and lower surfaces between which is coupled a back surface, a front left surface, and front right surface. A light bulb provides illumination and is positioned within the housing. A mesh and ventilation holes are integral with the upper and lower surfaces respectively for allowing heat transfer from the illumination source by convection to occur through the lower surface, within the housing, and out through the upper surface. A double glass pane within the front left and front right surface allows the sign to be protected on both sides of an at least semi-opaque sign and positions the sign within the front left and front right surfaces such that the sign is at least partially viewable from any approach angle. An access panel is removably attached to the front left and front right surfaces whereby access is obtained for the interchanging of the signs, such that upon selective activation of the illumination source the sign are at least partially illuminated.

2 Claims, 2 Drawing Sheets

ILLUMINATED SIGN DEVICE

BACKGROUND OF THE INVENTION

1. Field of the Invention

The present invention generally relates to illuminated signs and more specifically, to a safety sign that is selectively illuminated and at least partially viewable at any approach angle.

2. Description of Prior Art

The prior art is replete with various safety devices utilized to advise others of information. A lighted or unlighted sign is the most commonly used device, which may be used for such concerns as a warning, exit, or directional information. When the information conveyed by the sign is only intermittently in effect, the sign is then usually selectively illuminated. A visual indicator light is also another commonly utilized device to convey information, which is known in a wide range of varieties from a bare bulb to sophisticated lighting systems. While these types of devices are useful, there is disadvantages inherent with the use of the above described illuminated signs and visual indicator lights.

The typical illuminated sign is either positioned flat on a wall or at a ninety degree angle. This positioning restricts the viewing angle to approximately full side or frontal approaches. It is important that the sign be at least partially visible at all approaches or there may occur a failure to heed what a sign conveys. Light bulbs that illuminate from within an enclosure are prone to frequent failure because of poor heat convection. Frequently the sign is fixedly mounted and not interchangeable with other signs.

Visual indicator lights are particularly effective in high ambient noise areas and come in various revolving or strobe styles. A visual indicator light does not have restricted viewing angles, but lacks conveying all but the basic of information, such as "stay away". There are many incidents that require specific information, such as "goggles required" when a particular machine is in use. Unless a person is familiar with the exact meaning of a "flashing" light there again may occur a failure to heed what a light itself conveys.

While the prior art has reported using illuminated information devices none have established a basis for a specific device that is dedicated to the task of resolving the particular problem at hand.

What is needed in this instance is a safety sign with interchangeable sign capability, that may be selectively illuminated with sufficient heat convection for the illumination source, and at least partially viewable at any approach angle.

SUMMARY OF THE INVENTION

It is therefore one object of the invention to provide a safety sign device with interchangeable sign capability, that may be selectively illuminated with sufficient heat convection for the illumination source, and at least partially viewable at any approach angle.

According to the invention, an illuminated sign device is disclosed which includes within a triangular housing a illumination source. A mesh and ventilation holes allow heat transfer from the illumination source by convection to occur through a lower surface, within the housing, and out through an upper surface. A double glass pane within the front left and front right surface allows the sign to be protected on both sides of an at least semi-opaque sign and positions the sign within the front left and front right surfaces such that the sign is at least partially viewable from any approach angle. Access is obtained for the interchanging of the signs, such that upon selective activation of the illumination source the sign are at least partially illuminated.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
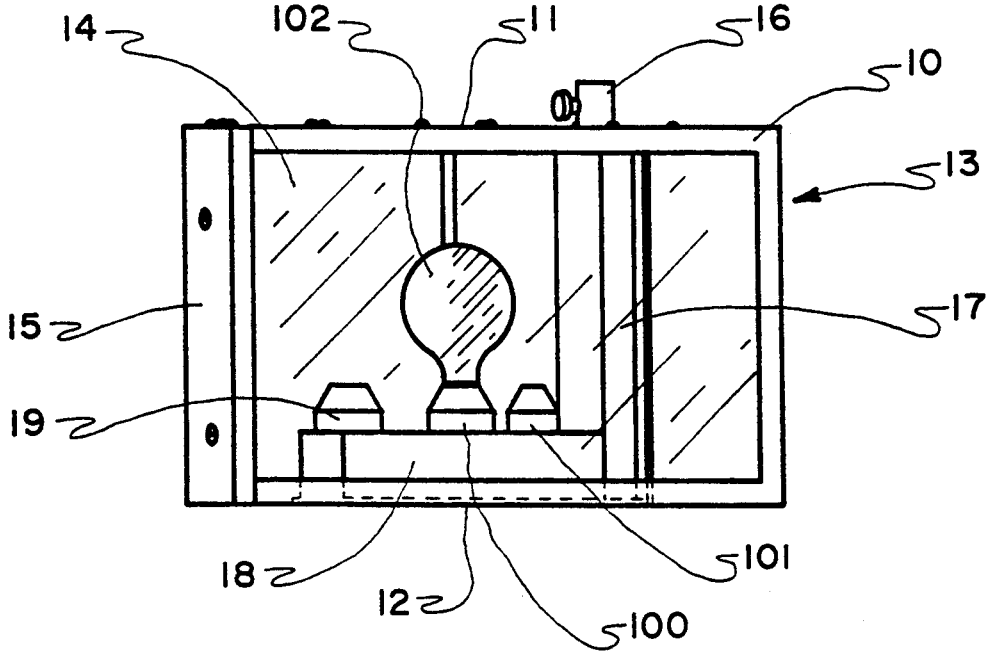
FIG. 1 is a right front view of the illuminated device without an inserted sign.
Figure 2:
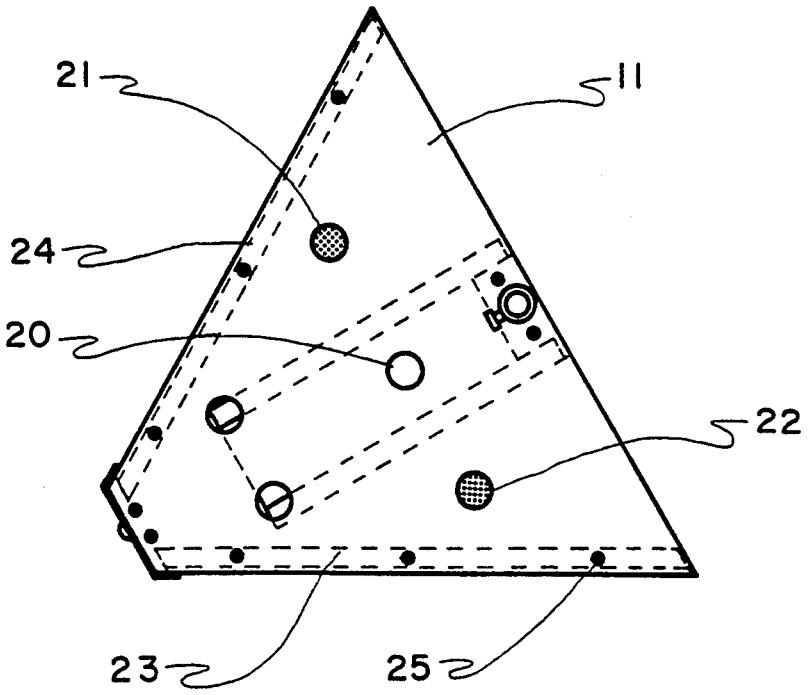
FIG. 2 is a top view of the illumination sign device showing the upper ventilation surface.
Figure 3:
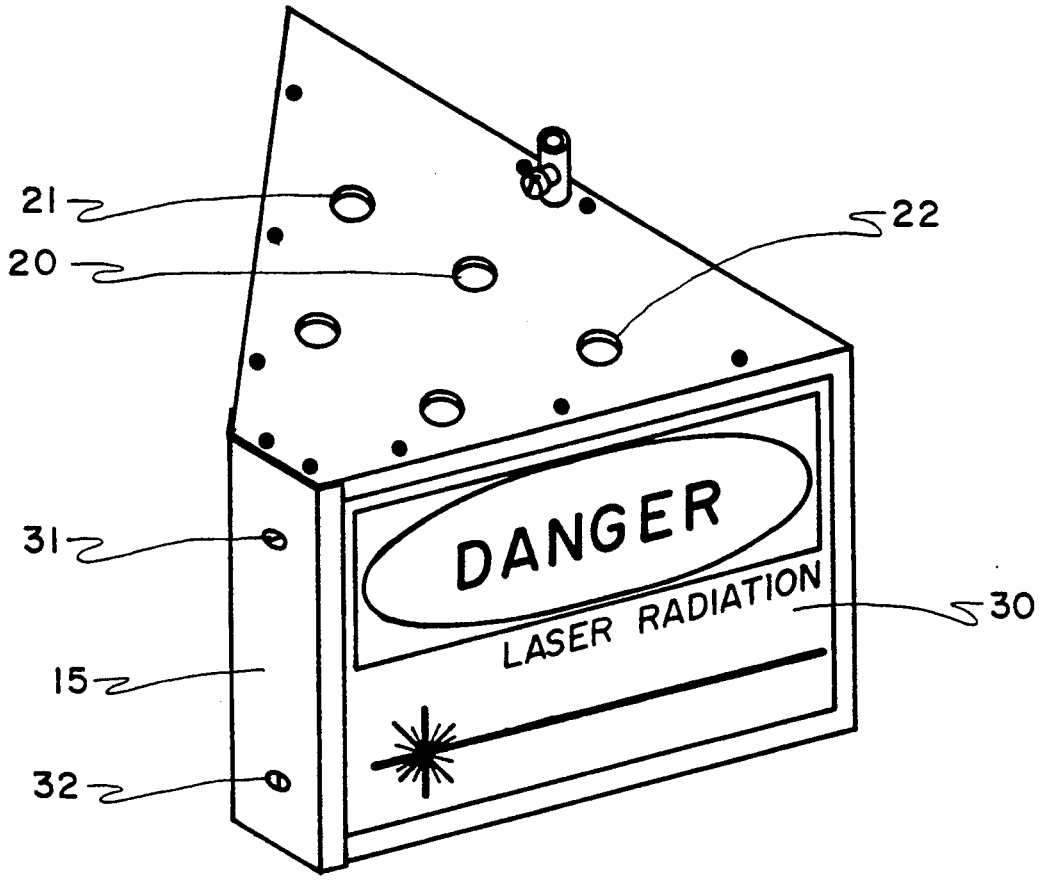
FIG. 3 is a right front view with a sign inserted within the illuminated sign device.

Referring now to the drawings, and more particularly to FIG. 1, there is shown the illuminated sign device of the present invention as seen from a right front view without an inserted sign. Triangular housing frame 10 includes upper and lower ventilation surfaces 11 and 12, and back surface 13, configured in a triangular shape as shown in FIGS. 2 and 3. The front right surface and front left surface of the device consist of dual glass panes, where dual glass panes 14 are shown if FIG. 1 as the front right surface. It is understood that any type of opaque material of suitable strength and protection may be used. Both sets of double glass panes are contained within removable end cap 15. Pipe connector 16 provides for vertical and horizontal suspension of the illumination device and allow electrical access to the interior of the illuminated sign device. In an alternative embodiment, back surface 13 of FIG. 1 may be coupled by suitable means to an appropriate surface such as a wall at a desired height, and through which electrical access to the interior may be provided. Wiring within the device is shielded within vertical shield 17 attached to back surface 13, for access to wiring box 18 that is attached horizontally to inside surface of lower ventilation surface 12. Wiring within wiring box 18 is electrically coupled to light receptacles 19, 100 and 101 that protrude upward and out of wiring box 18, with light bulb 102 shown as residing within receptacle 100. It is understood that the invention is not limited to the number of receptacles shown or type of illumination source, with any number of the receptacles which may be used at one time by an illumination source.

A top view of the illumination device showing upper ventilation surface 11 is shown in FIG. 2. Upper ventilation surface 11 includes ventilation holes such as ventilation hole 20, while the lower ventilation surface consists of a mesh which can be seen through ventilation holes 21 and 22. While both upper ventilation surface 11 and the lower ventilation surface function as part of frame 10 of FIG. 1 to contain, support and protect the device, there is also heat transfer by convection that is allowed. Because of the heat that is generated by light sources such as bulb 102 there is the heat build-up within the device which can cause premature burn-out and wiring loss. With the permeable nature of both upper and lower ventilation surfaces there is allowed the movement of the ambient air up through the lower ventilation surface, into the device, over all light sources within the device, and out through ventilation holes in the upper ventilation surface. While holes have been shown as the preferred embodiment for the ventilation means any suitable means to allow heat convection to occur as described above may be used. Suitable attachment means, such as screws 25 shown in FIG. 2 are utilized to attach upper and lower ventilation surfaces to frame 10 of FIG. 1.

Double glass panes 14 of FIG. 1 and the double glass panes of the front left surface (not shown) are contained in sliding relationship within tracks 23 and 24 respectively at the triangular arrangement shown. The double glass panes as the window display means function to allow light to pass therethrough to the outside of the illumination device and to protect the sign not only from the outside element but also from any heat build-up from the interior of the housing. A light permeable sign is placed in between each set of double panes as shown in FIG. 3. The triangular arrangement for the front left and right surface allow for the sign to be at least partially viewable from any approach angle. Sign 30 is shown in between double glass planes 14 which is the sign utilized in the preferred embodiment. By releasing screws 31 and 32, end cap 15 is removed so as to allow placement of a sign in between double glass panes of front right and left surfaces. The double glass panes are removable by sliding along and out of tracks 23 and 24. After a desired sign is placed within the double glass panes, it and the panes are slidingly replaced within tracks 23 and 24, with end cap 15 of FIG. 1 reattached. It is understood that a sign of any material may be placed within the device as long as at least part of the sign is semi-permeable to light.

In the preferred embodiment the illumination device is physically attached to a wall above an entrance way within which is located laser equipment. When the laser equipment is operated, the operator and all occupants must take proper eye safety precaution. The illumination source of the preferred embodiment is common light bulb 102 as shown in FIG. 1, with a common blinking disk element inserted (not shown) within receptacle 100. The illumination device of FIG. 3 is turned on before activation of the laser equipment. The illumination sign device is activated by turning on the illumination source through a room electrical switch (not shown). Sign 30 is then shown as blinking which therefore alerts those outside the entrance way of the safety hazard currently in effect, and is at least partially viewable at any approach angle.

While this invention has been described in terms of preferred embodiment consisting of a laser safety sign, those skilled in the art will recognize that the invention can be practiced with modification within the spirit and scope of the appended claims.

Having thus described my invention, what I claim as new and desire to secure by Letters Patent is as follows:

1. An illuminated sign device comprising:

a triangular housing with upper and lower surfaces between which is coupled a back surface, a front left surface, and front right surface;

illumination means positioned within the housing;

ventilation means integral with the upper and lower surfaces for allowing heat transfer from the illumination means by convection to occur through the lower surface, within the housing, and out through the upper surface;

sign display means within the front left and front right surface both which is opaque to the illumination source, whereby the sign display means protects both sides of an at least semi-opaque sign and positions the sign within the front left and front right surfaces such that the sign is at least partially viewable from any approach angle;

access means removably attached to the front left and front right surfaces whereby access is obtained for the interchanging of the signs, such that upon selective activation of the illumination source the sign are at least partially illuminated.

2. The illumination sign device of claim 1 wherein the sign display means is a double pane of glass between which is insertable a sign.

* * * * *